US005362148A

United States Patent [19]

Lehrke et al.

[11] Patent Number: 5,362,148

[45] Date of Patent: Nov. 8, 1994

[54] ROTARY AGITATOR WITH CONCENTRIC SUCTION TUBE

[75] Inventors: Kenneth E. Lehrke, Maple Grove; Gerard L. Lehman, Champlin; Scott C. Losey, Minneapolis, all of Minn.

[73] Assignee: Graco Inc., Golden Valley, Minn.

[21] Appl. No.: 203,336

[22] Filed: Feb. 28, 1994

[51] Int. Cl.[5] ..... B01F 15/02; B01F 7/24

[52] U.S. Cl. ..... 366/163; 366/191; 366/249

[58] Field of Search ..... 366/102–104, 366/138, 154, 155, 163, 164, 191, 197, 199, 241–251, 262–265, 266, 308, 331, 342, 343; 261/119.1

[56] References Cited

U.S. PATENT DOCUMENTS

| | | | |
|---|---|---|---|
| 931,153 | 8/1909 | Silberhorn | 366/102 |
| 1,167,536 | 1/1916 | Tokheim . | |
| 1,956,788 | 5/1934 | Blum . | |
| 2,193,934 | 3/1940 | Moores . | |
| 2,215,912 | 9/1940 | Plummer . | |
| 2,283,904 | 5/1942 | Baumgarden . | |
| 3,243,164 | 3/1966 | Von Gustorf et al. | 366/262 |
| 3,256,987 | 6/1966 | Isenhardt et al. | 366/102 X |
| 3,322,403 | 5/1967 | Murphy | 366/247 |
| 3,468,520 | 9/1969 | Duryea et al. . | |
| 3,999,741 | 12/1976 | Richards . | |
| 4,478,519 | 10/1984 | Guibert . | |
| 4,678,341 | 7/1987 | Stuckey . | |
| 4,859,073 | 8/1989 | Howseman, Jr. et al. . | |
| 5,193,908 | 3/1993 | Rescorla et al. . | |

*Primary Examiner*—Stephen F. Gerrity
*Assistant Examiner*—Charles Cooley
*Attorney, Agent, or Firm*—Palmatier, Sjoquist & Helget

[57] ABSTRACT

A rotary agitator with a concentric suction tube suspended from a housing which has a seal connection for attachment to a drum or other large container. The suction tube is fixedly mounted within the housing and includes a flow path extending from a bottom end below the rotary agitator and to a top end above the rotary agitator. A drive motor is affixed to the housing and is coupled to the rotary agitator by a belt drive and pulley attachment to the exterior walls of the agitator tube; the lower portion of the agitator tube having a helical screw for immersion into the liquid contained in the drum or container.

14 Claims, 2 Drawing Sheets

ROTARY AGITATOR WITH CONCENTRIC SUCTION TUBE

BACKGROUND OF THE INVENTION

This invention relates to a rotary agitator for insertion into a large container such as a drum, in combination with a suction tube for removing liquid from the container.

Mechanical agitators and liquid pumps for agitating and removing liquid from large containers are known in the art, because there has long been a problem with storing liquids over indeterminate times in large containers while at the same time maintaining the liquid in condition for immediate use. Many liquids comprise mixtures of various components which may tend to settle out or separate over extended storage periods, particularly when stored in large drums. It, therefore, has become necessary to continuously agitate the liquid in order to maintain uniform consistency prior to use. The liquid may then be removed by pumping at any time for delivery to a point of application, and the user can be assured that the component consistency of the liquid is uniform.

Typical large containers have a bung hole opening for obtaining access to the interior liquid without entirely removing the cover. A threadable plug is usually inserted into the bung hole opening, and the plug may be removed for access to the liquid without unduly exposing the interior liquid to the outside air. One of the problems in preserving this limited access to the interior of the drum is that the agitator and the pumping mechanism must both be insertable through the bung hole opening.

This problem has been solved in U.S. Pat. No. 5,193,908, issued Mar. 16, 1993, by providing a rotary agitator having an elongated rotatable tube with a helical agitator flight affixed to the outside of the tube. The interior of the tube is hollow, and the lower end of the tube is open to receive liquid from the container. The top end of the tube is closed and adapted for connection to a rotary motor, and a number of ports are provided through the sidewalls of the tube proximate the top end. These ports are in flow communication with an exterior port in the housing of the apparatus, and a suitable pumping device may be connected to the exterior port for providing suction forces to remove liquid from the container via the hollow tube. The housing is threadably secured to the bung hole opening, and an auxiliary air inlet is provided to permit pressure equalization into the container interior as the liquid material is withdrawn. One problem with this construction is that the drive motor rotates the entire tube; and therefore, dynamic liquid seals must be provided between the rotatable tube and the interior housing in order to prevent leakage of the pumped liquid into the interior of the housing, or to prevent air from entering into the liquid flow path within the housing. If air leaks into the liquid flow path, it becomes entrained in the liquid volume flow and is delivered to the point of application. If the applicator is a spray gun or other similar device, the entrained air becomes ejected by the applicator as noticeable "spitting," thereby disturbing the uniform flow rate delivery of the application. This emission can also disturb the uniform application of the liquid to an article when the spray gun applicator is intended for applying a fine, uniform finish to the article.

SUMMARY OF THE INVENTION

The present invention comprises an elongated tube having a helical agitator flight about its exterior surface, the top portion of the tube being enclosed within a housing and being supported along its axial length by bearings. The tube is rotatably coupled to a drive motor. A fixed suction tube is concentrically positioned inside of the agitator tube and is adapted for connection to a suitable suction pump. An air valve is connected to a passage internal the housing and provides for the equalization of pressure when the housing is secured to the top cover of a drum or container.

It is a principal object of the present invention to provide a rotatable agitator for insertion into a large container or drum and to provide a suction tube within the agitator for removing liquid from the drum.

It is another object of the present invention to provide a rotatable agitator and a suction tube without requiring dynamic fluid seals to prevent leakage.

It is yet another object of the present invention to provide a fixed suction tube concentrically positioned within a rotatable tubular agitator without the necessity of dynamically sealing one from the other.

The foregoing and other objects and advantages of the present invention will become apparent from the following specification and claims and with reference to the appended drawings.

DESCRIPTION OF THE PREFERRED EMBODIMENT

Figure 1:
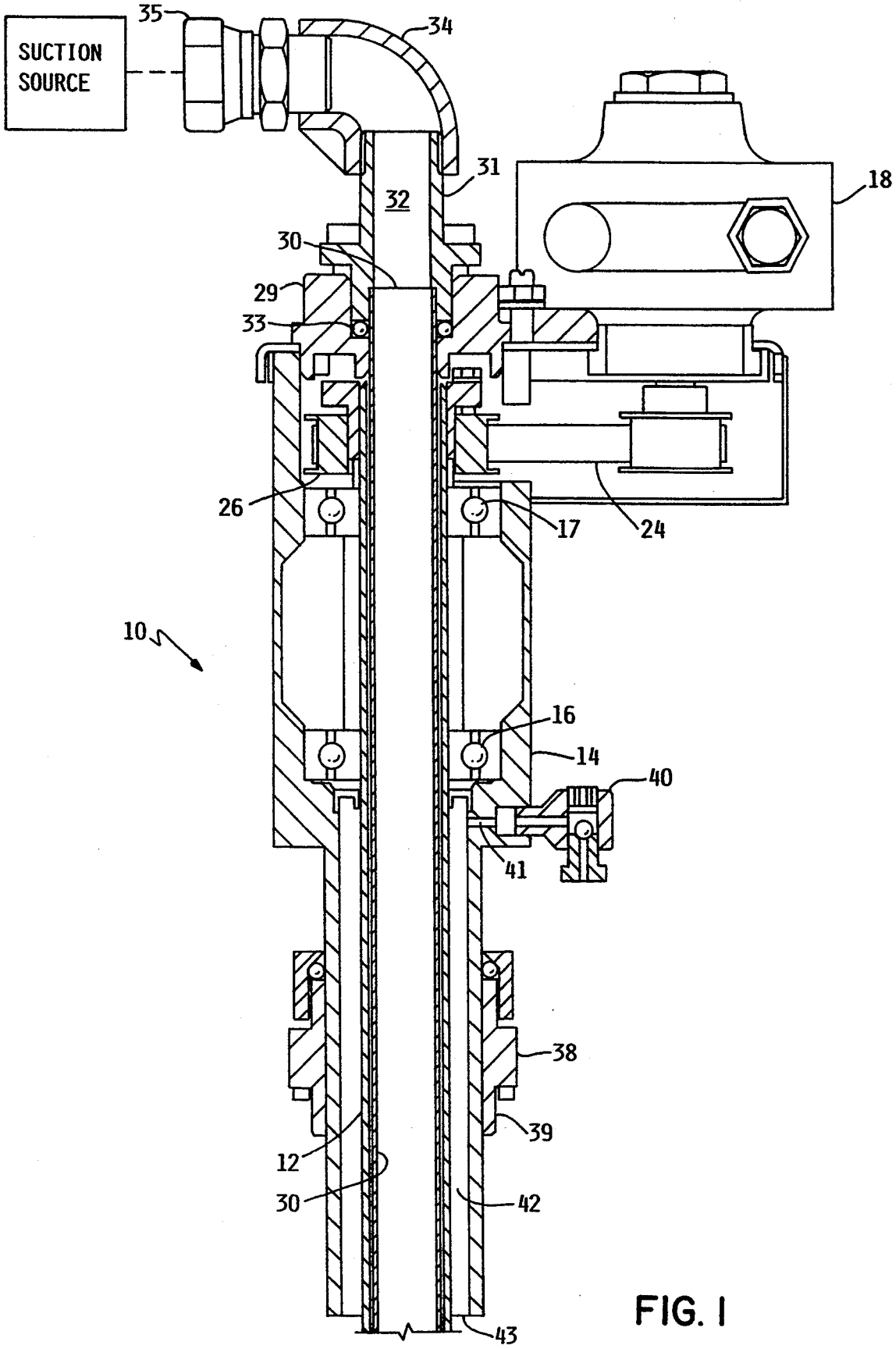
FIG. 1 shows a cross-sectional view of the upper portion of a rotary agitator with a concentric suction tube.

FIG. 1 shows the rotary agitator and suction tube apparatus 10 in elevation view and in partial cross section. An agitator tube 12 is axially aligned within a housing 14 and is axially supported for rotational movement by means of bearings 16, 17. Housing 14 also supports a drive motor 18 at an axially offset position relative to agitator tube 12. A motor drive shaft 20 is connected to a drive pulley 22, and an endless belt 24 is connected about pulley 22 and an agitator tube pulley 26. Agitator tube pulley 26 is affixed to the exterior surface of agitator tube 12 and is rotatable therewith.

A suction tube 30 is clamped at its top end in housing 14 and is concentrically aligned within agitator tube 12. Suction tube 30 extends axially beyond the top end of agitator tube 12 and also extends axially beyond the bottom end of agitator tube 12. Suction tube 30 is open at both of its ends and is in flow connection to a passage 32 in a fitting 31, and a pipe elbow 34 affixed to fitting 31. The end of pipe elbow 34 is adapted to accommodate a coupler 35 for connection to a suitable suction pump device. An O-ring 33 is clamped about suction tube 30 between the fitting 31 and a fitting 29 which is attached to housing 14.

A check valve 40 is affixed to housing 14, and an air passage 41 is formed through the exterior wall of housing 14 to come into flow communication with check valve 40. The other side of check valve 40 is open to atmosphere. Passage 41 opens into a concentric chamber 42 which is formed between the outside surface of agitator tube 12 and the inside surface of housing 14. Chamber 42 is downwardly opened at exit 43 about agitator tube 12.

A rotatable seal 38 is concentrically fitted about housing 14 for securing the apparatus 10 to the threaded bung hole opening of a large drum. The lower portion 39 of seal 38 has a threaded surface which is sized for engagement with corresponding threads in the drum cover.

Figure 2:
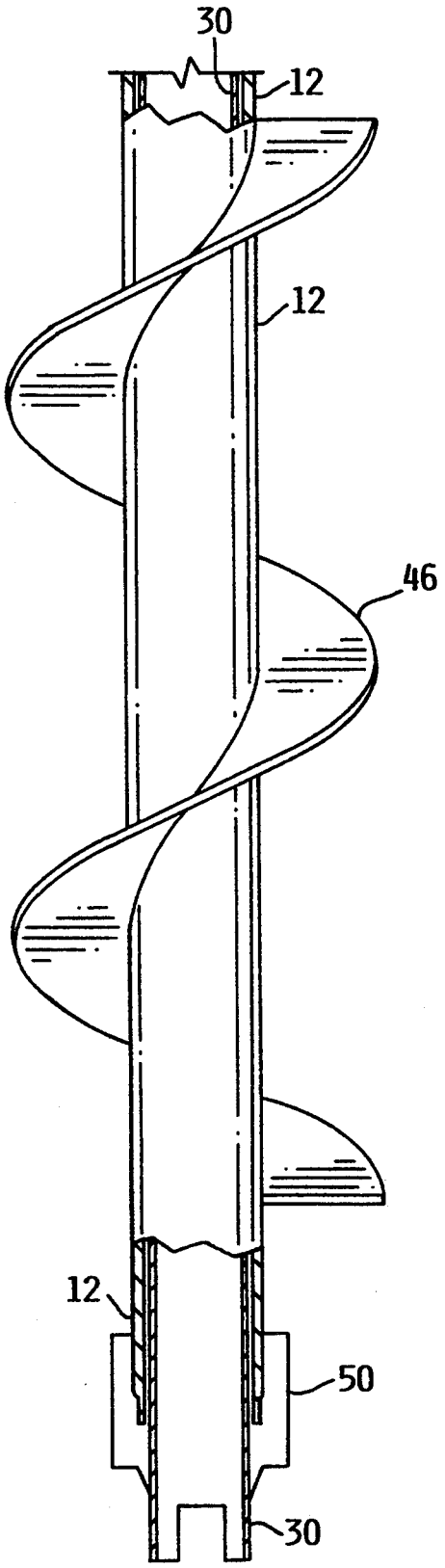
FIG. 2 shows a partial cross-section view of the lower portion of the rotary agitator with a concentric suction tube.

FIG. 2 shows an elevation view, and partial cross section, of the lower portion of the agitator tube and suction tube construction. A helical screw 46 is affixed about the exterior surface of agitator tube 12. Of course, other forms of agitator construction could also be affixed to the exterior surface of agitator tube 12; for example, blades, vanes, or other projections which may suitably agitate the liquid upon rotation of agitator tube 12. The lower end of suction tube 30 extends downwardly beneath the end of agitator tube 12, and a resilient bearing/seal member 50 is affixed to the lower end of suction tube 30. The bearing/seal member 50 is sized to snugly fit over the lower outer surface of agitator tube 12, thereby to provide a liquid seal between the exterior surface of suction tube 30 and the interior surface of agitator tube 12 and also to provide a bearing surface to guide the rotation of agitator tube 12 relative to the end of suction tube 30. Since there is no pressure differential across bearing/seal member 50, it is not susceptible to leakage forces; it serves the primary function of merely maintaining the concentricity alignment of the suction tube 30 relative to the agitator tube 12 while the agitator tube 12 is in rotational motion. If a small amount of liquid seepage does bypass the bearing-/seal member 50, it does not adversely affect performance and, therefore, needs only to be cleaned periodically.

In operation, the coupler 35 is connected to a suitable suction pump device and the motor 18 is connected to a suitable power source. In each case, the respective suction pump device and power source may be driven by pressurized air, or alternatively may be an electromechanical drive source. The apparatus 10 is then inserted through the bung hole opening of a large container or drum, and seal 38 is secured to the cover of the container or drum. The motor and pump may then be activated to cause the rotational motion of agitator tube 12 and the helical screw 46, while simultaneously drawing liquid through the lower end of suction tube 30. As the liquid is drawn from the drum, the air pressure inside the drum is equalized by the flow of air through check valve 40 and into the interior drum via the space 42 between housing 14 and agitator tube 12. The liquid flow path through suction tube 30, passage 32, elbow 34 and coupler 35 is completely enclosed and isolated from the possibility of air leakage. Since there are no dynamic seals required between the liquid flow path and the rotatable agitator, there can be no subsequent deterioration of sealing members which could otherwise lead to air leakage. The rotatable motion of the agitator tube 12 about its concentric suction tube 30 is entirely supported by bearings 16, 17 constrained within housing 14 and is guided by bearing/seal member 50 at the lower end of the apparatus.

The present invention may be embodied in other specific forms without departing from the spirit or essential attributes thereof; and it is, therefore, desired that the present embodiment be considered in all respects as illustrative and not restrictive, reference being made to the appended claims rather than to the foregoing description to indicate the scope of the invention.

What is claimed is:

1. An agitator and suction tube apparatus for attachment to a container for removing liquid therefrom while agitating said liquid, comprising:

a) a housing having a lower housing end and an upper housing end, and means for attachment to said container located above said lower housing end;

b) a suction tube having an open top end and a predetermined length with an open bottom end, said top end being fixedly attached to said housing and said bottom end being downwardly extendable into said container;

c) an agitator tube concentrically aligned about said suction tube and having a length shorter than said predetermined length, with a top end in said housing and a downwardly positioned bottom end;

d) liquid agitator projections affixed to the exterior surface of the lower portion of said agitator tube, and a drive pulley affixed about said agitator tube proximate said agitator tube top end;

e) at least one bearing in said housing and rotatably guiding said agitator tube in spaced-apart relationship relative to said lower housing end;

f) a rotatable drive motor affixed to said housing and means for rotatably coupling said drive motor to said drive pulley; and g) means for connecting said suction tube open top end to a suction source.

2. The apparatus of claim 1, further comprising a bearing and seal member engaged between the respective bottom ends of said suction tube and said agitator tube.

3. The apparatus of claim 2, wherein said bearing and seal member is affixed to said suction tube and extends over the bottom end of said agitator tube.

4. The apparatus of claim 1, further comprising an opening through said housing at a position above said means for attachment to said container.

5. The apparatus of claim 4, further comprising a check valve connected to said opening.

6. The apparatus of claim 1, wherein said liquid agitator projections further comprise a helical flight.

7. The apparatus of claim 1, wherein said at least one bearing further comprises two bearings at spaced-apart positions in said housing and concentrically aligned about said agitator tube.

8. The apparatus of claim 1, wherein said means for attachment to said container further comprises a threaded seal member about said housing, adapted for threadably securing through an opening in said container.

9. An agitator and suction tube apparatus adapted for attachment to a threaded bung hole opening in a drum cover, comprising:

a) a housing having an external threadable member sized for threadable engagement to said bung hold opening; said housing having a lower housing end positionable below said bung hole opening;

b) an elongate suction tube having a top end affixed to said housing and having a bottom end extending beneath said threadable member;

c) a suction port opening in said housing, and a passage connecting said suction port opening to said suction tube top end;

d) an agitator tube concentrically and rotatably positioned about said suction tube, and bearing means for rotatably supporting said agitator tube in said housing, said agitator tube extending downwardly beneath said threadable member in spaced-apart relationship to said lower housing end;

e) liquid agitator projections affixed to said agitator tube at positions beneath said threadable member;

f) means for rotating said agitator tube, said means for rotating being attached to said housing; and g) means for connecting a suction device to said suction port opening.

10. The apparatus of claim 9, further comprising a bearing and seal member engaged between said agitator tube and said suction tube.

11. The apparatus of claim 10, wherein said bearing and seal member is formed of a resilient material affixed to said suction tube and extending over a bottom end of said agitator tube.

12. The apparatus of claim 9, wherein said liquid agitator projections further comprise a helical flight about said agitator tube.

13. The apparatus of claim 9, wherein said means for rotating said agitator tube further comprises a motor and drive pulley, a driven pulley affixed to said agitator tube, and an endless belt extending about said pulleys.

14. The apparatus of claim 9, wherein said bearing means further comprises two spaced-apart bearings in said housing, each of said bearings extending about said agitator tube.

* * * * *